US010373425B2

(12) United States Patent
Nelson

(10) Patent No.: US 10,373,425 B2
(45) Date of Patent: Aug. 6, 2019

(54) SYSTEM AND METHOD FOR AUTOMATICALLY CREATING AND UPDATING A FRIEND DATABASE ASSOCIATED WITH A PLAYER

(71) Applicant: IGT, Las Vegas, NV (US)

(72) Inventor: Dwayne R. Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 889 days.

(21) Appl. No.: 14/321,292

(22) Filed: Jul. 1, 2014

(65) Prior Publication Data

US 2016/0005255 A1 Jan. 7, 2016

(51) Int. Cl.
*G07F 17/32* (2006.01)

(52) U.S. Cl.
CPC ..... *G07F 17/323* (2013.01); *G07F 17/3232* (2013.01); *G07F 17/3272* (2013.01); *G07F 17/3274* (2013.01)

(58) Field of Classification Search
CPC ..... G07F 17/32; G07F 17/3255
USPC ..... 463/18–20, 40–42
See application file for complete search history.

(56) References Cited

U.S. PATENT DOCUMENTS 4,494,197 A 1/1985 Troy et al.
4,624,459 A 11/1986 Kaufman et al.
4,669,730 A 6/1987 Small et al.
5,092,598 A 3/1992 Kamille et al.
5,327,365 A 7/1994 Fujisaki et al.
5,586,937 A 12/1996 Menashe
5,588,913 A 12/1996 Hecht
5,602,845 A 2/1997 Walh
5,944,606 A 8/1999 Gerow et al.
6,024,640 A 2/2000 Walker et al.
6,079,711 A 6/2000 Wei et al.
6,117,009 A 9/2000 Yoseloff
6,142,872 A 11/2000 Walker et al.
6,159,096 A 12/2000 Yoseloff
6,210,276 B1 4/2001 Mullins
6,220,961 B1 4/2001 Keane et al.
6,238,288 B1 5/2001 Walker et al.
6,254,483 B1 7/2001 Acres
6,309,298 B1 10/2001 Gerow
6,361,441 B1 3/2002 Walker et al.
(Continued)

*Primary Examiner* — Omkar A Deodhar
*Assistant Examiner* — Ross A Williams
(74) *Attorney, Agent, or Firm* — Neal, Gerber & Eisenberg LLP

(57) ABSTRACT

Various embodiments of the present disclosure provide a system and method for automatically creating and updating a friend database associated with a player. Generally, in various embodiments, the system of the present disclosure is configured to access one or more player accounts (such as social media accounts) of the player, collect player friend data from the accessed player account(s), determine a list or one of more friends of the player based on the collected player data, and create or update a friend database associated with the player to include the determined friends. The system of the present disclosure thus dynamically and automatically creates and updates the friend database associated with the player without requiring the player to actively create and repeatedly and actively update (e.g., add friends to and remove friends from) the friend database.

13 Claims, 8 Drawing Sheets

(56) References Cited

U.S. PATENT DOCUMENTS 6,368,218 B2 4/2002 Angell, Jr.
6,422,940 B1 * 7/2002 Walker ..... G07F 17/3244 273/292
6,443,837 B1 9/2002 Jaffe et al.
6,443,838 B1 9/2002 Jaimet
6,471,591 B1 10/2002 Crumby
6,524,184 B1 2/2003 Lind et al.
6,533,664 B1 3/2003 Crumby
6,569,016 B1 5/2003 Baerlocher
6,645,077 B2 11/2003 Rowe
6,688,977 B1 2/2004 Baerlocher et al.
6,692,354 B2 2/2004 Tracy et al.
6,712,693 B1 3/2004 Hettinger
6,780,110 B2 8/2004 Baerlocher et al.
6,793,578 B2 9/2004 Luccesi et al.
6,796,902 B2 9/2004 Baerlocher et al.
6,800,026 B2 10/2004 Cannon
6,802,778 B1 10/2004 Lemay et al.
6,857,961 B2 2/2005 Soltys et al.
6,964,612 B2 11/2005 Soltys et al.
7,011,309 B2 3/2006 Soltys et al.
7,070,505 B2 7/2006 Vancura et al.
7,170,997 B2 1/2007 Petersen et al.
7,192,348 B2 3/2007 Brosnan et al.
7,222,852 B2 5/2007 Soltys et al.
7,311,598 B2 12/2007 Kaminkow et al.
7,341,513 B2 3/2008 Cuddy et al.
7,364,510 B2 4/2008 Walker et al.
7,371,166 B1 5/2008 Webb et al.
7,390,256 B2 6/2008 Soltys et al.
7,393,280 B2 7/2008 Cannon
7,448,626 B2 11/2008 Fleckenstein
7,452,272 B2 11/2008 Walker et al.
7,481,709 B2 1/2009 Bussick et al.
7,563,167 B2 7/2009 Walker et al.
7,588,496 B2 9/2009 Van Asdale
7,597,621 B2 10/2009 Baerlocher
7,651,392 B2 1/2010 Pennington et al.
7,753,782 B2 7/2010 Cuddy et al.
7,758,423 B2 7/2010 Foster et al.
7,789,755 B2 9/2010 Davis et al.
7,819,745 B2 10/2010 Cuddy et al.
7,828,649 B2 11/2010 Cuddy et al.
7,854,654 B2 12/2010 Baerlocher et al.
7,857,699 B2 12/2010 Baerlocher
7,862,423 B2 1/2011 Walker et al.
7,883,413 B2 2/2011 Paulsen
8,016,662 B1 9/2011 Hamman et al.
8,033,912 B2 10/2011 Cannon
8,070,587 B2 12/2011 Davis et al.
8,079,903 B2 12/2011 DeWaal et al.
8,087,999 B2 1/2012 Nicely et al.
8,092,297 B2 1/2012 Oberberger et al.
8,105,149 B2 1/2012 Decasa et al.
8,109,821 B2 1/2012 DeWaal
8,118,662 B2 2/2012 Kovacs et al.
8,118,666 B2 2/2012 Caputo et al.
8,177,633 B2 2/2012 Nicely et al.
8,210,935 B2 5/2012 Baerlocher et al.
8,216,065 B2 7/2012 Caputo et al.
8,226,467 B2 7/2012 Kaminkow et al.
8,231,448 B2 7/2012 Weber et al.
8,251,791 B2 7/2012 Cuddy et al.
8,292,723 B2 10/2012 DeWaal
8,371,938 B2 2/2013 Peterson
8,382,572 B2 2/2013 Hoffman et al.
8,393,968 B2 3/2013 Nicely et al.
8,496,519 B2 7/2013 Hoffman et al.
8,500,548 B2 8/2013 Baerlocher et al.
8,602,865 B2 12/2013 Zielinski
8,747,206 B2 6/2014 Walker et al.
2002/0042296 A1 4/2002 Walker et al.
2002/0072404 A1 6/2002 Gerow
2002/0113369 A1 8/2002 Weingardt
2004/0002376 A1 1/2004 Swift et al.
2004/0116174 A1 6/2004 Baerlocher et al.
2005/0143170 A1 6/2005 Maya et al.
2006/0025210 A1 2/2006 Johnson
2006/0069619 A1 3/2006 Walker et al.
2006/0073874 A1 4/2006 Cregan et al.
2006/0079318 A1 * 4/2006 Aoki ..... G07F 17/3223 463/25
2006/0252515 A1 11/2006 Walker et al.
2008/0026824 A1 1/2008 Muir
2008/0076527 A1 3/2008 Low et al.
2008/0113763 A1 5/2008 Michaelson et al.
2008/0113768 A1 5/2008 Baerlocher
2009/0042644 A1 2/2009 Zielinski
2009/0042652 A1 2/2009 Baerlocher et al.
2009/0088239 A1 4/2009 Iddings et al.
2009/0117970 A1 5/2009 De Waal et al.
2009/0124316 A1 5/2009 Baerlocher et al.
2009/0124327 A1 5/2009 Caputo et al.
2009/0124362 A1 5/2009 Cuddy et al.
2010/0025931 A1 2/2010 Walker et al.
2010/0120497 A1 5/2010 Weber et al.
2010/0124971 A1 5/2010 Baerlocher et al.
2010/0137056 A1 6/2010 Hoffman et al.
2010/0244380 A1 9/2010 Walker et al.
2011/0029622 A1 2/2011 Walker et al.
2011/0111826 A1 5/2011 Baerlocher et al.
2011/0111827 A1 5/2011 Nicely et al.
2011/0118010 A1 5/2011 Brune
2011/0230251 A1 9/2011 Nicely et al.
2012/0108319 A1 5/2012 Caputo et al.
2012/0270646 A1 10/2012 Walker et al.
2012/0311036 A1 * 12/2012 Huhn ..... G06Q 10/10 709/204
2012/0322560 A1 * 12/2012 Joo ..... A63F 13/73 463/42
2013/0012293 A1 1/2013 Walker et al.
2013/0079088 A1 3/2013 Lafky et al.
2013/0079114 A1 3/2013 Nicely et al.
2013/0084941 A1 4/2013 Caputo et al.
2013/0090156 A1 4/2013 Oh et al.
2013/0274009 A1 10/2013 Bryson et al.
2014/0080579 A1 * 3/2014 Abouchar ..... G07F 17/3255 463/25

* cited by examiner

| List of Facebook® friends |
| --- |
| John Smith |
| John Smith |
| John Doe |
| John Doe |
| ⋮ |
| Dwayne Nelson |

300

| Friend Database |
| --- |
| John Smith |
| John Smith |
| John Doe |
| John Doe |
| ⋮ |
| Dwayne Nelson |

400

SYSTEM AND METHOD FOR AUTOMATICALLY CREATING AND UPDATING A FRIEND DATABASE ASSOCIATED WITH A PLAYER

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Certain known gaming systems enable players to manually create databases or lists that include friends of the player, and provide certain functionality based on the friend databases or lists (such as person-to-person chat functionality). More specifically, these known gaming systems require the player to: (a) manually type in or otherwise manually input identifying information (such as a name) for each friend the player desires to include in the player's friend database, and (b) continuously monitor and update the player's friend database to manually add friends to and/or manually remove friends from the player's friend database. This is a time-consuming, repetitive process that may dissuade certain players from creating a friend database and reaping the benefits of the added functionality.

A need thus exists for a time-saving, easy to use system for automatically creating and updating a friend database associated with a player.

SUMMARY

Various embodiments of the present disclosure provide a system and method for automatically creating and updating a friend database associated with a player. Generally, in various embodiments, the system of the present disclosure is configured to access one or more player accounts (such as social media or social networking accounts) of the player, collect player friend data from the accessed player account(s), determine a list or one of more friends of the player based on the collected player data, and create or update a friend database associated with the player to include the determined friends. The system of the present disclosure thus dynamically and automatically creates and updates the friend database associated with the player without requiring the player to actively create and repeatedly and actively update (e.g., add friends to and remove friends from) the friend database.

More specifically, in operation of one embodiment, the system accesses, through a data network, a player account associated with a player such that the system can collect player friend data from the accessed player account. The system collects the player friend data from the accessed player account. The system uses the collected player friend data to determine one or more friends of the player. The system determines whether a stored friend database associated with the player exists. If the system determines that a stored friend database associated with the player does not exist, the system creates and stores a friend database associated with the player including the determined one or more friends. If, on the other hand, the system determines that that a stored friend database associated with the player exists, the system updates the stored friend database to include each determined friend not already included in the stored friend database. The system provides additional functionality for the player based at least in part on the stored friend database associated with the player.

The system of the present disclosure thus automatically creates and updates a friend database associated with the player, which enables the system to provide additional functionality to the player without requiring the player to perform the time-consuming process of manually creating and updating a friend database.

Additional features and advantages are described herein, and will be apparent from, the following Detailed Description and the Figures.

DETAILED DESCRIPTION

General System Operation

Figure 1:
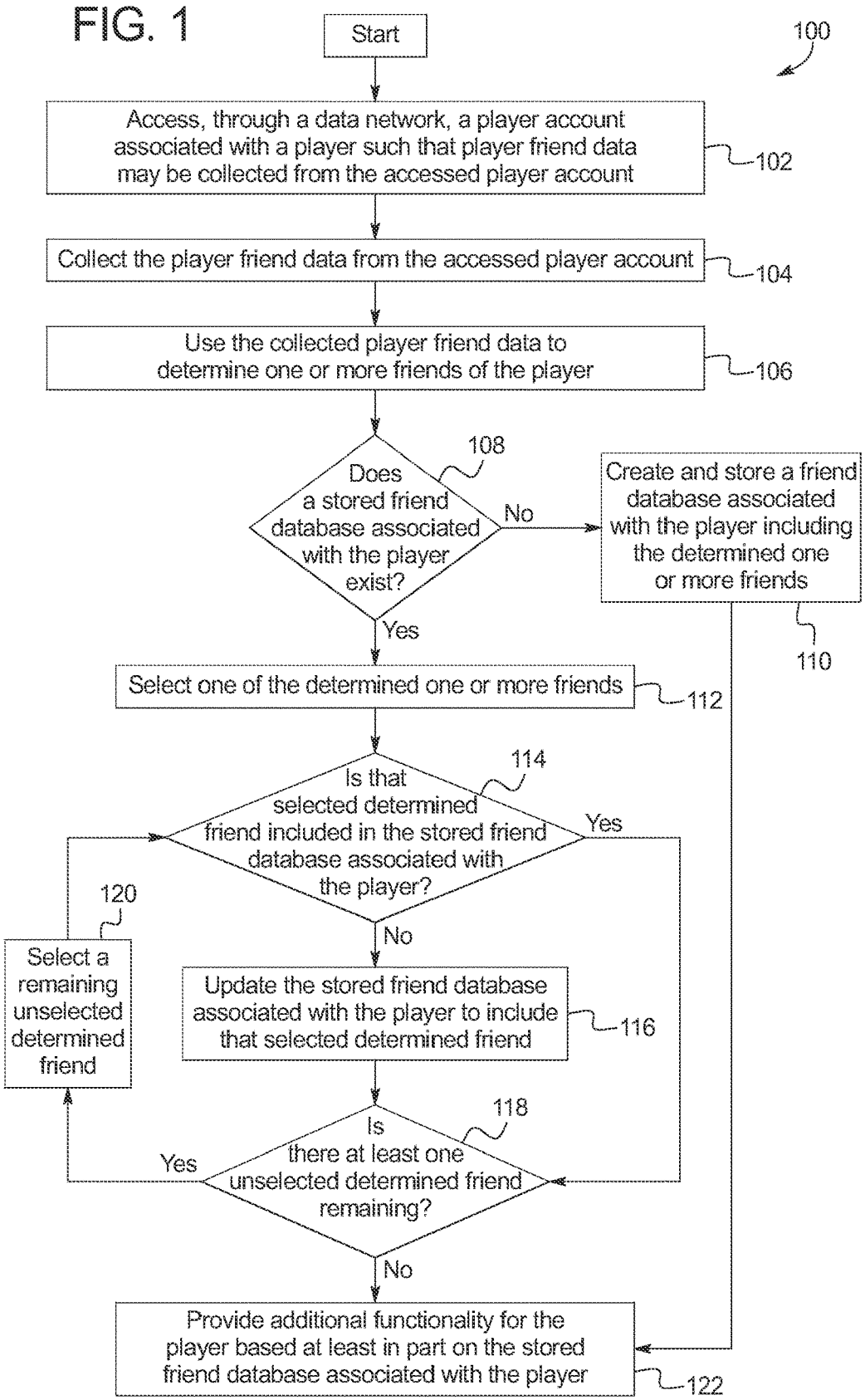
FIG. 1 is a flowchart illustrating an example method of operating one embodiment of the system of the present disclosure.

FIG. 1 illustrates a flowchart of an example process or method 100 of operating one embodiment of the system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this embodiment, the system accesses, through a data network, a player account associated with a player such that player friend data may be collected from the accessed player account, as indicated by block 102. The system collects player friend data from the accessed player account, as indicated by block 104. The system uses the collected player friend data to determine one or more friends of the player, as indicated by block 106. The system determines whether a stored friend database associated with the player exists, as indicated by diamond 108. If the system determines at the diamond 108 that a stored friend database associated with the player does not exist, the system creates and stores a friend database associated with the player including the determined one or more friends, as indicated by block 110. The process 100 then proceeds to block 122, described below.

If, on the other hand, the system determines at the diamond 108 that a stored friend database associated with the player exists, the system selects one of the one or more determined friends, as indicated by block 112. The system determines whether that selected determined friend is included in the stored friend database associated with the player, as indicated by diamond 114. If the system determines at the diamond 114 that the selected determined friend is not included in the stored friend database associated with the player, the system updates the stored friend database associated with the player to include that selected determined friend, as indicated by block 116. The process 100 then proceeds to diamond 118, described below.

If, on the other hand, the system determines at the diamond 114 that that the selected determined friend is included in the stored friend database associated with the player, the system determines whether there is at least one unselected determined friend remaining, as indicated by the diamond 118. If the gaming system determines at the diamond 118 that there is at least one unselected determined friend remaining, the system selects a remaining unselected determined friend, as indicated by block 120. The process 100 then returns to the diamond 114. If, on the other hand, the gaming system determines at the diamond 118 that there are no unselected determined friends remaining, the system provides additional functionality for the player based at least in part on the stored friend database associated with the player, as indicated by the block 122.

Each step of the process 100 is described in detail below.

1. Types of Player Accounts

The system may access and collect player friend data from any suitable player account of the player such as, but not limited to: (a) a social media or social networking account of the player (such as the player's FACEBOOK® account (FACEBOOK® is a registered trademark of Facebook, Inc.); the player's TWITTER® account (TWITTER® is a registered trademark of Twitter, Inc.); the player's GOOGLE+® account (GOOGLE+® is a registered trademark of Google Inc.); the player's PINTEREST® account (PINTEREST® is a registered trademark of Pinterest, Inc.); the player's TUMBLR® account (TUMBLR® is a registered trademark of Tumblr, Inc.); the player's REDDIT® account (REDDIT® is a registered trademark of Reddit, Inc.); the players LINKEDIN® account (LINKEDIN® is a registered trademark of LinkedIn, Ltd.); the player's MYSPACE® account (MYSPACE® is a registered trademark of MySpace LLC); the player's SNAPCHAT® account (SNAPCHAT® is a registered trademark of Snapchat, Inc.); the player's INSTAGRAM® account (INSTAGRAM® is a registered trademark of Instagram, LLC); the player's FLICKR® account (FLICKR® is a registered trademark of Yahoo! Inc.); and the like); (b) an email account of the player (such as the player's OUTLOOK® email account (OUTLOOK® is a registered trademark of Microsoft Corporation); the player's GMAIL® email account (GMAIL® is a registered trademark of Google Inc.); the player's YAHOO!® email account (YAHOO!® is a registered trademark of Yahoo! Inc.); and the like); (c) a web-based or online casino account of the player; (d) an instant messaging account of the player (such as the player's GCHAT® account (GCHAT® is a registered trademark of Google Inc.)); and/or (e) a video messaging account of the player (such as the player's SKYPE® account (SKYPE® is a registered trademark of Microsoft Corporation)).

It should be appreciated that the player account(s) that the system is configured to access and from which the system is configured to collect player friend data is(are) distinct from and in addition to any player tracking or player loyalty account of the player that is maintained by a gaming establishment. Additionally, in certain embodiments, the system is separate from and in addition to any player tracking systems, while in other embodiments at least one player tracking system is configured to act as the system.

The present disclosure contemplates various manners in which the system determines the particular player account(s) of the player from which to collect player friend data. In certain embodiments, the system enables the player to pick and choose which particular player accounts the system may access to collect player friend data. In other embodiments, the system automatically chooses which player accounts the system may access to collect player friend data. For instance, in one example embodiment, the system uses certain information about the player (such as the player's name) to identify player accounts of the player, and subsequently accesses those identified player accounts to collect player friend data. In another example embodiment, the system uses information stored on a personal electronic device (PED) of the player (such as applications or software installed on the PED of the player) to identify player accounts of the player. The PED may be any suitable electronic device such as, but not limited to: a mobile phone, a tablet computing device, a laptop computing device, a fitness tracking device, or a wearable electronic device.

2. Accessing a Player Account Such that Player Friend Data May be Collected from the Accessed Player Account As generally noted above, the system accesses, through a data network, a player account associated with a player such that the system can collect player friend data from the accessed player account.

In certain embodiments, the system requires the player to provide the system the player's login credentials (e.g., the player's username and password) for a particular player account to enable the system to use those login credentials to access that particular player account such that the system can collect player friend data from that particular player account. In these embodiments, the system cannot otherwise access that particular player account such that the system can collect player friend data from that particular player account. In one such embodiment, the system can access certain portions of that particular player account without the player's login credentials, but cannot access that particular player account such that the system can collect player friend data from that particular player account. In another such embodiment, the system cannot access that particular player account at all without the player's login credentials.

For instance, in one example embodiment, if a player configures her FACEBOOK® account to disable all public access to the player's FACEBOOK® account, the system cannot access the player's FACEBOOK® account at all without using the FACEBOOK® account login credentials of the player. Accordingly, the gaming system requires the player to provide the system the player's FACEBOOK® account login credentials to enable the system to access the player's FACEBOOK® account such that the system can collect player friend data from the player's FACEBOOK® account.

In another example embodiment, if a player configures her FACEBOOK® account to disable public access to the player's FACEBOOK® account friends list and enables public access to the player's FACEBOOK® account profile, the system can access part of the player's FACEBOOK® account without the player's FACEBOOK® account login credentials, but cannot access the player's FACEBOOK® account such that the system can collect player friend data from the player's FACEBOOK® account. Accordingly, in this example embodiment, the gaming system requires the player to provide the system the player's FACEBOOK® account login credentials to enable the system to access the player's FACEBOOK® account such that the system can collect player friend data from the player's FACEBOOK® account.

In another example embodiment, if a player configures her FACEBOOK® account to disable public access to the player's FACEBOOK® account Wall and enables public access to the player's FACEBOOK® account friends list, the system can access part of the player's FACEBOOK® account without the player's FACEBOOK® account login credentials such that that the system can collect player friend data from the player's FACEBOOK® account. Accordingly, in this example embodiment, the gaming system does not require the player to provide the system the player's FACEBOOK® account login credentials because the system can already access the player's FACEBOOK® account such that the system can collect player friend data from the player's FACEBOOK® account.

The system may receive the login credentials for a particular player account in any suitable manner. In one embodiment, the system requires the player to actively provide the player's login credentials, such as by using a service window on an electronic gaming machine (EGM) at which the player is playing or using an application or software installed on the user's PED. In another embodiment, the system retrieves the player's login credentials from the player's PED without requiring the player to actively provide the system with the login credentials, such as by accessing a stored login credential database stored on the player's PED. In another embodiment, the system actively requests the player's login credentials from the PED, and the PED provides the system with the player's login credentials after receiving an input from the player indicating that the PED may do so.

In other embodiments, the system does not require the player to provide the system the player's login credentials (if any) to enable the system to access a particular player account such that the system can collect player friend data from that particular player account. Thus, in these embodiments, the system can access that particular player account such that the system can collect player friend data from that particular player account without using the login credentials (if any) of the player.

For instance, in one example embodiment, if a player configures her FACEBOOK® account to enable public access to the player's FACEBOOK® account, including the player's FACEBOOK® account friends list, the system can access the player's FACEBOOK® account to collect player friend data without using the player's FACEBOOK® account login credentials. Accordingly, in this example embodiment, the gaming system does not require the player to provide the system the player's FACEBOOK® account login credentials because the system can already access the player's FACEBOOK® account such that the system can collect player friend data from the player's FACEBOOK® account.

In certain embodiments, regardless of whether the system requires the player to provide the system the player's login credentials for a particular player account to enable the system to use those login credentials to access that particular player account such that the system can collect player friend data from that particular player account, the system requires the player to assent to the system accessing that particular player account such that the system can collect player friend data from that particular player account. In other words, in these embodiments, the system enables the player to actively choose to which (if any) player accounts to grant the system access and from which (if any) player accounts the system may collect player friend data. This enables the player to prevent the system from accessing any player accounts that the player desires to keep private. For instance, in one embodiment in which the player's PED includes an application that enables the PED to communicate with the system, the application enables the player to choose the particular player account(s) of the player that the system may access and from which the system may collect player friend data.

In various embodiments, the system is configured to automatically connect to and retrieve information from a PED of the player. The system is configured to connect to and retrieve information from the player's PED via a data network, such as a BLUETOOTH® connection (BLUETOOTH® is a registered trademark of Bluetooth SIG, Inc.), a wireless internet connection, a wireless intranet connection, a near field communication connection, and the like. In these embodiments, once the system connects to the player's PED, the system communicates with and retrieves certain information from the player's PED that enables the system to access one or more player accounts of the player such that the system can collect player friend data from those one or more player accounts.

For instance, in one example embodiment, a player carrying his mobile phone walks into a gaming establishment. The mobile phone connects to a wireless internet signal provided by the gaming establishment. The system connects to and communicates with the player's mobile phone via the internet signal and retrieves the player's FACEBOOK® account ID from a FACEBOOK® application on the player's mobile phone. Using the player's FACEBOOK® account ID, the system then accesses the player's FACEBOOK® account such that the system can collect player friend data from the player's FACEBOOK® account (assuming that the player's login credentials are not required for such access, as described above).

In certain embodiments, the system provides a benefit to the player in exchange for the player enabling the system to access at least one player account of the player. For instance, in one example embodiment, the system employs a router (such as a CISCO® CMX Router) that provides a player free wireless internet access in exchange for the player enabling the system access to the player's FACEBOOK® account such that the system can collect player friend data from the player's FACEBOOK® account. It should be appreciated that the system may provide any suitable benefit(s).

3. Collecting the Player Friend Data from the Accessed Player Account

Once the system accesses the player account such that the system can collect player friend data from the accessed player account, the system collects the player friend data from the accessed player account in any suitable manner. For instance, in one example embodiment, the system accesses a player's FACEBOOK® account such that the system can collect player friend data from the player's FACEBOOK® account. The system queries FACEBOOK® for the player's FACEBOOK® account friends list and receives the player's FACEBOOK® account friends list. In another example, embodiment, the system accesses a player's FACEBOOK® account such that the system can collect player friend data from the player's FACEBOOK® account. The system queries FACEBOOK® for the data included on the player's FACEBOOK® account Wall and receives such data. In another example embodiment, the system accesses a player's FACEBOOK® account such that the system can collect player friend data from the player's FACEBOOK® account. The system queries FACEBOOK® for the player's FACEBOOK® message interactions and receives the player's FACEBOOK® account friends list.

4. Using the Collected Player Friend Data to Determine One or More Friends of the Player After collecting the player friend data from the player account, the system processes the collected player friend data in any suitable manner and generates a list of one or more friends of the player. For instance, in one example embodiment, the system collects player friend data in the form of postings to a player's FACEBOOK® account Wall. In this example embodiment, the system determines which persons (other than the player) authored any postings to the player's FACEBOOK® account Wall, and generates a list of one or more friends of the player including those persons (other than the player) who authored postings to the player's FACEBOOK® account Wall. In another example embodiment, the system collects player friend data in the form of the player's FACEBOOK® message interactions. In this example embodiment, the system determines which persons the player was messaging with, and generates a list of one or more friends of the player with whom the player was messaging.

5. Creating and/or Updating a Friend Database Associated with the Player

Once the system generates the list of one or more friends, the system determines whether at least one memory device of the system already stores a friend database associated with the player. If the system determines that the at least one memory device already stores a friend database associated with the player, the system updates the stored friend database to include any of the one or more friends included in the generated list that are not already included in the stored friend database. If the system determines that the at least one memory device does not already store a friend database associated with the player, the system creates a friend database associated with the player including the list of one or more friends and stores the created friend database in the at least one memory device.

In various embodiments, the system is configured to remove one or more friends from the friend database associated with the player based on the list of friends. For instance, if the system already stores a friend database associated with the player and the list of friends does not include a friend that is included in the stored friend database, the system removes that friend from the stored friend database. In other words, in these embodiments, once the system has created a friend database, each subsequent time the system access all of the player accounts and creates a list of friends based on player friend data collected from those player accounts, the system updates the friend database by: (a) adding to the friend database any friends included in the friend list and not included in the friend database; (b) removing from the friend database any friends included in the friend database and not included in the friend list; and (c) maintaining in the friend database any friends included in both the friend list and the friend database.

In certain embodiments, the system enables the player to select which friends included in the list of one or more friends to include in the friend database associated with the player. More specifically, in one such example embodiment, for each of the one or more friends included in the list of friends, the system enables the player to input whether the player desires to include that friend in the stored friend database associated with the player. If the system receives an input indicating that the player desires to include that friend in the stored friend database associated with the player, the system updates the stored friend database associated with the player to include that friend if the stored friend database does not already include that friend. If, on the other hand, the system receives an input indicating that the player does not desire to include that friend in the stored friend database associated with the player, the system does not update the stored friend database associated with the player to include that friend. Thus, in these embodiments, the system enables the player to pick and choose the particular friends (as determined by the system) with whom the player would like to be associated.

In certain embodiments, the system enables the player to manually add one or more friends to or remove one or more friends from the friend database associated with the player. In these embodiments, such manual entry is in addition to the automatic creation and/or updating of the friend database associated with the player based on player friend data collected from one or more player accounts of the player.

In other embodiments, rather than first generating a complete list of one or more friends and then comparing that complete list to the stored friend database associated with the player to determine whether to add any of the friends included in the list to the friend database, the gaming system makes the comparison contemporaneously with identifying each friend based on the collected player friend data (who would otherwise be included in the complete list of friends).

6. Providing Additional Functionality for the Player

Once the system has created and/or updated the friend database associated with the player, the system provides additional functionality for the player based at least in part on the stored friend database associated with the player. Four categories of types of additional functionality that the system may provide for the player are described below, though it should be appreciated that the system may provide any suitable type of additional functionality.

a. Awards

In various embodiments, the additional functionality includes at least one award provided to the player. It should be appreciated that the award may be any suitable award.

In one embodiment, the system provides the player an award if the quantity of friends included in the friend database associated with the player exceeds a designated quantity. For instance, in one example embodiment, the system provides the player with a voucher redeemable for $10.00 worth of credits once the quantity of friends included in the friend database associated with the player exceeds one hundred.

In another embodiment, the system provides the player an award as long as the quantity of friends included in the friend database associated with the player remains at or above a designated quantity. For instance, in one example embodiment, the system provides the player with double the player tracking points as long as the quantity of friends included in the friend database associated with the player exceeds one hundred.

In another embodiment, the system provides the player an award once a quantity of friends included in the friend database associated with the player who are located at a particular gaming establishment reaches a designated quantity. For instance, in one example embodiment, the system provides the player with a free night's stay at Casino A's hotel once the quantity of friends included in the friend database associated with the player who are located at Casino A exceeds fifty.

In another embodiment, the system provides the player an award as long as the quantity of friends included in the friend database associated with the player who are located at a particular gaming establishment remains at or above a designated quantity. For instance, in one example embodiment, the system provides the player with an increased average expected payback percentage as long as the quantity of friends included in the friend database associated with the player who are located at Casino A exceeds fifty.

b. Award Opportunities

In various embodiments, the additional functionality includes at least one bonus game playable by the player and at least one of the friends included in the stored friend database associated with the player.

In one such embodiment, if: (a) a bonus triggering event associated with a play of a first game by the player occurs, and (b) a friend included in the stored friend database associated with the player is actively playing a gaming system, the system causes at least one bonus game to be provided to the player and the friend. In one embodiment, the at least one bonus game includes a communal bonus game playable by both the player and the friend. In one embodiment, the communal bonus game is a team-based bonus game in which the system assigns the player and the friend to a same team. In another embodiment, the at least one bonus game includes a first bonus game playable by the player and a second bonus game separately playable by the friend.

In one such embodiment, if: (a) a bonus triggering event associated with a play of a first game by the player occurs, and (b) a friend included in the stored friend database associated with the player initiates a play of a second game on a gaming system within a designated period of the occurrence of the bonus triggering event, the system causes at least one bonus game to be provided to the player and the friend. In one embodiment, the at least one bonus game includes a communal bonus game playable by both the player and the friend. In one embodiment, the communal bonus game is a team-based bonus game in which the system assigns the player and the friend to a same team. In another embodiment, the at least one bonus game includes a first bonus game playable by the player and a second bonus game separately playable by the friend.

In another such embodiment, if: (a) a bonus triggering event associated with a play of a first game by a friend included in the stored friend database associated with the player occurs, and (b) the player is actively playing a gaming system, the system causes at least one bonus game to be provided to the friend and the player. In one embodiment, the at least one bonus game includes a communal bonus game playable by both the friend and the player. In another embodiment, the at least one bonus game includes a first bonus game playable by the friend and a second bonus game separately playable by the player.

In another such embodiment, if: (a) a bonus triggering event associated with a play of a first game by a friend included in the stored friend database associated with the player occurs, and (b) the player initiates a play of a second game on a gaming system within a designated period of the occurrence of the bonus triggering event, the system causes at least one bonus game to be provided to the friend and the player. In one embodiment, the at least one bonus game includes a communal bonus game playable by both the friend and the player. In another embodiment, the at least one bonus game includes a first bonus game playable by the friend and a second bonus game separately playable by the player.

In another such embodiment, if: (a) a bonus triggering event associated with a play of a first game by the player occurs, and (b) a bonus triggering event associated with a play of a second game by a friend included in the stored friend database associated with the player occurs within a designated period of the occurrence of the bonus triggering event associated with the play of the first game by the player, the system causes at least one bonus game to be provided to the player and the friend. In one embodiment, the at least one bonus game includes a communal bonus game playable by both the player and the friend. In another embodiment, the at least one bonus game includes a first bonus game playable by the player and a second bonus game separately playable by the friend.

In another such embodiment, if: (a) a bonus triggering event associated with a play of a first game by a friend included in the stored friend database associated with the player occurs, and (b) a bonus triggering event associated with a play of a second game by the player occurs within a designated time period of the occurrence of the bonus triggering event associated with the play of the first game by the friend, the system causes at least one bonus game to be provided to the friend and the player. In one embodiment, the at least one bonus game includes a communal bonus game playable by both the friend and the player. In another embodiment, the at least one bonus game includes a first bonus game playable by the friend and a second bonus game separately playable by the player.

The designated period may be any suitable period, such as a period of time or a quantity of plays of a game.

In certain such embodiments, the player and the friend must be playing at the same gaming establishment for the system to provide such additional functionality, while in other embodiments the player and the friend need not be playing at the same gaming establishment for the system to provide such additional functionality.

It should be appreciated that the player and the friend may be playing any suitable gaming systems, as described below. For instance, in one example embodiment, the player is playing at an EGM while the friend is playing on the friend's cell phone. In another example embodiment, the player and the friend are both playing at EGMs. In another example embodiment, the player is playing on the player's tablet computing device and the friend is playing on the friend's laptop computer.

c. Player Updates and/or Friend Updates

In various embodiments, the additional functionality includes notifications of designated events that occur in association with the friends included in the stored friend database associated with the player.

In one such embodiment, if a designated event (or one of a plurality of different designated events) occurs in association with a play of a game by a friend included in the stored friend database associated with the player, the system causes the gaming system of the player to display or otherwise indicate a game update associated with that designated event and that friend. For instance, in one example embodiment in which the designated event is a jackpot win, when a friend included in the stored friend database associated with the player achieves a jackpot win, the system causes the gaming system of the player (such as the EGM of the player or the PED of the player) to display a notification that the friend achieved the jackpot win.

The designated event may be any suitable event such as, but not limited to, one or more of: (a) the friend achieving a designated award or one of a plurality of designated awards; (b) the friend achieving a designated quantity of consecutive winning outcomes during a gaming session (such as five winning plays of a game in a row); (c) a credit balance of the friend reaching a designated credit balance; (d) the friend achieving a play of a bonus game; (e) the friend achieving a hand-pay; (f) the friend beginning a gaming session; (f) the friend ending a gaming session; (g) the friend moving to a different location within a gaming establishment; (h) the friend making a reservation (such as a dinner reservation); (i) the friend purchasing a ticket to an event (such as a ticket to a show at the gaming establishment); (j) the friend achieving a particular outcome (e.g., a Royal Flush); (k) the friend achieving a particular achievement (e.g., unlocking all bonus games available on a gaming system or playing all games in a particular set or collection of games); and (l) the friend playing for at least a designated period of time.

In certain embodiments, the additional functionality includes the system accessing and updating the player's player account to include notifications of designated events, such as (but not limited to) any of the above-listed designated events, that occur in association with the player.

In one such embodiment, if a designated event (or one of a plurality of different designated events) occurs in association with a play of a game by the player, the system accesses the player's player account such that the system can update the player account and updates the player's player account based on the occurrence of that designated event. For instance, in one example embodiment in which the designated event is a jackpot win, when the player achieves a jackpot win, the system accesses and updates the player's player account to indicate that the player achieved the jackpot win.

d. Player-to-friend Connectivity

In various embodiments, the additional functionality includes a displayed list of the friends in the friend database associated with the player who are located within a certain vicinity of the player. For instance, in one example embodiment the system causes a gaming system of the player (and/or a PED of the player) to display a list of any of the friends in the friend database associated with the player who are playing a gaming system in the same gaming establishment as the player. In another example embodiment, the system causes the gaming system of the player to indicate a location of such friends, such as by displaying a map of the gaming establishment that indicates the locations of such friends.

In certain embodiments, the additional functionality includes enabling the player to chat with one or more of the friends of the player included in the friend database associated with the player. For instance, the system employs an instant message or a video message type chat interface to enable the chat functionality.

In certain embodiments, the additional functionality includes enabling the player to invite one or more of the friends of the player included in the friend database associated with the player to play a particular game, with or without the player.

In certain embodiments, the additional functionality includes enabling the player to invite one or more of the friends of the player included in the friend database associated with the player to play at a gaming system near the player (such as next to the player).

7. Variations

In various embodiments, the system is configured to collect other data from a player's player account and use that data to provide additional functionality to the player. More specifically, in such embodiments, the system is configured to: (a) access a player account of a player such that the system can collect data other than player friend data from that player account, (b) collect that other data from that player account, and (c) use the collected data (alone or in combination with any collected player friend data) to provide additional functionality to the player.

The data other than the player friend data may be any other suitable data such as, but not limited to, data related to: (a) any relationship of the player (e.g., whether the player is married or single); (b) the player's gender; (c) the player's work history; (d) the player's affiliations (e.g., the player's preferred sports team); (e) the player's likes (e.g., the bands the player likes); (f) the player's dislikes (e.g., the types of food the player dislikes); (g) the player's educational history (e.g., the university the player attended); (h) the player's political affiliation (e.g., Democrat or Republican); (i) the player's home address (e.g., the player lives in Illinois); (j) the player's travel history (e.g., the player travels via air once every two weeks); and/or (k) the games or types of games the player has played in the past (e.g., FACEBOOK® games the player has previously played and/or games installed on the player's PED).

It should be appreciated that the system may provide any suitable additional functionality for the player based (at least in part) on the collected other data. For instance, in one example embodiment, the system provides a team-based bonus game including one team of Democrats playing against another team of Republicans. In another example embodiment, the system provides a team-based bonus game including one team of players who went to X college against another team of players who went to rival Y college. In another example embodiment, the system provides a leaderboard ranking all players who live in California. In another embodiment, the system provides a communal bonus game to two players who both work in the technology industry.

In certain embodiments, the system uses the collected other data to customize a user interface of the player and/or to customize game play of the player. For instance, in various embodiments, the system uses the collected other data to: (a) determine a preferred EGM domination of the player; (b) determine a list of preferred primary games of the player; (c) determine a list of preferred bonus games of the player; (d) determine a list of preferred themes of the player; and/or (e) determine a list of preferred game music of the player.

In various embodiments, the system accesses the player account(s) of the player periodically (such as hourly, daily, weekly, monthly, quarterly, or yearly) to update the friend database associated with the player. In certain embodiments, the system enables the player to cause the system to access the player account(s) of the player. For instance, if the player just added ten friends to the player's FACEBOOK® account, the player may provide an input to the system to cause the system to access the player's FACEBOOK® account and update the friend database associated with the player to include those ten new friends. In certain embodiments, the system enables the player to actively cause the system to access the player account(s) of the player.

It should be appreciated that the system of the present disclosure may employ any suitable security measures to protect players' privacy and personal information in accordance with the jurisdiction(s) within which the system is operated. It should also be appreciated that the system of the present disclosure may comply with the policies and/or prohibitions of any virtual currency with which the system is used.

Example Embodiment

One example embodiment of the system in operation is described below in accordance with FIGS. 2A, 2B, 2C, 2D, and 2E. In this example embodiment, the system 210 is configured to communicate with a mobile phone 220 of a player through a data network 215*a*, such as a wireless internet connection. Additionally, in this example embodiment, the system 210 is configured to communicate with a plurality of EGMs 230*a*, 230*b*, . . . 230*z* over a data network 215*b*, such as a wired LAN connection. It should be appreciated that the data networks 215*a* and 215*b* may be any suitable data network. In this embodiment, the data networks 215*a* and 215*b* are differently, though it should be appreciated that such data networks may be the same data network.

Figure 2A:
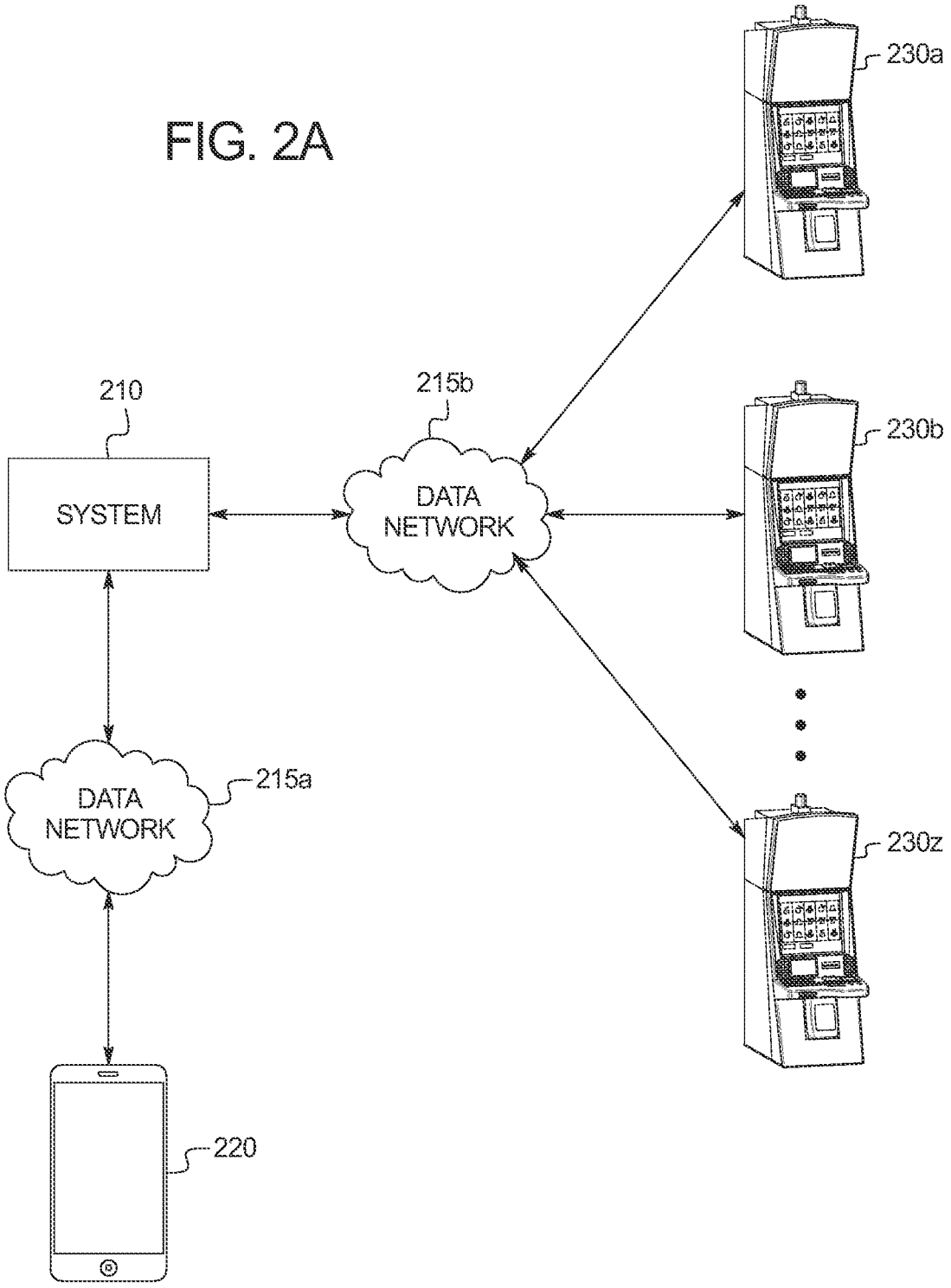
FIGS. 2A, 2B, 2C, 2D, and 2E illustrate an example of the operation of the system of the present disclosure.
Figures 2B, 2C, 2D:
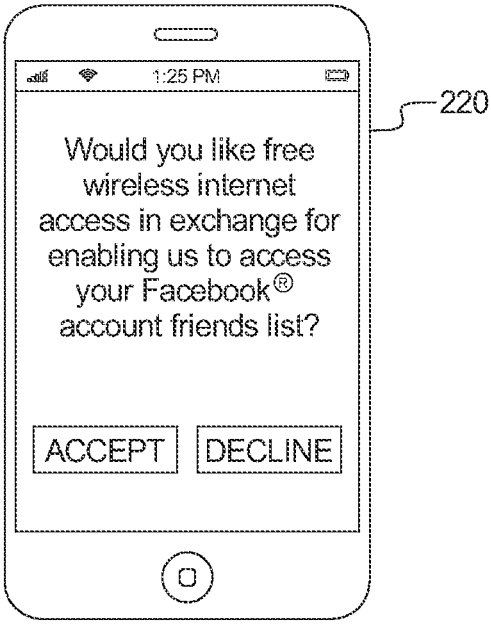

In this example embodiment, the system 210 is configured to automatically connect to and communicate with the player's mobile phone 220 when the player's mobile phone connects to the data network 215*a*. In this example embodiment, as shown in FIG. 2B, when the player carries her mobile phone 220 into a gaming establishment, the mobile phone 220 connects to the data network 215*a* and the system 210 connects to and communicates with the player's mobile phone 220 via the data network 215*a*. In this example embodiment, the system provides free wireless internet access (i.e., a benefit) to the player in exchange for the player enabling the system 210 to access the player's FACEBOOK® account friends list such that the system 210 can collect player friend data from the player's FACEBOOK® account. As shown in FIG. 2B, the system 210 causes the mobile phone 220 of the player to display the offer to the player and enable the player to accept or decline the offer.

In this example embodiment, the player's mobile phone 220 receives an indication that the player accepts the offer, and sends such indication to the system 210. The system 210 then: (a) provides free wireless internet access to the player, (b) accesses the player's FACEBOOK® account, (c) collects player friend data from the player's FACEBOOK® account, and (d) creates a list of a plurality of friends of the player based on the collected player friend data. FIG. 2C illustrates a table including the list of friends. The system 210 determines that at least one memory device of the system does not already store a player friend database associated with the player. Accordingly, the system 210 creates a friend database associated with the player including the list of friends, as shown in FIG. 2D, and stores the friend database in the at least one memory device of the system 210.

Figure 2E:
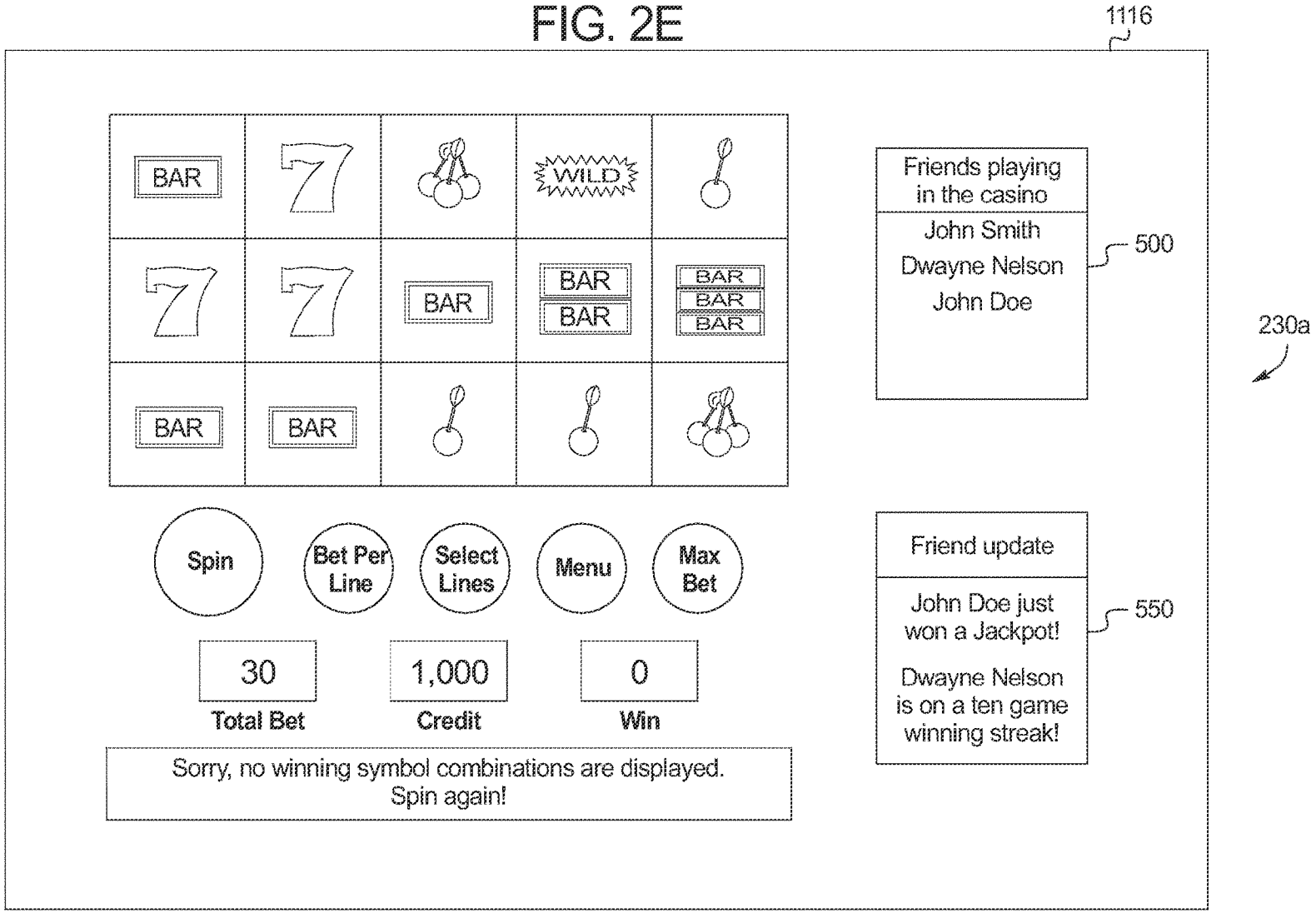

As shown in FIG. 2E, the system provides additional functionality for the player based on the friend database associated with the player by: (a) displaying on a display device 1116 of the player's EGM 230*a* (and/or on a display device of the player's mobile phone 220) a list of the friends 500 in the friend database associated with the player who are playing a gaming system in the same casino as the player; and (b) displaying on the display device 1116 of the player's EGM 230*a* (and/or on a display device of the player's mobile phone 220) a notification when one of a plurality of designated events occurs in association with a friend included in the friend database associated with the player.

System Components

It should be appreciated that the embodiments of the system described herein may be implemented in accordance with or in conjunction with one or more of a variety of different types of systems, such as, but not limited to, those described below.

The present disclosure contemplates a variety of different systems each having one or more of a plurality of different features, attributes, or characteristics. It should be appreciated that a system as used herein refers to various configurations of: (a) one or more central servers, central controllers, or remote hosts; and/or (b) one or more PEDs, such as desktop computers, laptop computers, tablet computers or computing devices, personal digital assistants (PDAs), mobile telephones such as smartphones, and other mobile computing devices.

Thus, in various embodiments, the system of the present disclosure includes: (a) one or more PEDs in combination with one or more central servers, central controllers, or remote hosts; (b) a single PED; (c) a plurality of PEDs in combination with one another; (d) a single central server, central controller, or remote host; and/or (e) a plurality of central servers, central controllers, or remote hosts in combination with one another.

For brevity PED or a plurality of PEDs, and "central server, central controller, or remote host" as used herein represents one central server, central controller, or remote host or a plurality of central servers, central controllers, or remote hosts.

As noted above, in various embodiments, the system includes a PED in combination with a central server, central controller, or remote host. In such embodiments, the PED is configured to communicate with the central server, central controller, or remote host through a data network or remote communication link. In certain such embodiments, the PED is configured to communicate with another PED through the same data network or remote communication link or through a different data network or remote communication link.

In certain embodiments in which the system includes a PED in combination with a central server, central controller, or remote host, the central server, central controller, or remote host is any suitable computing device (such as a server) that includes at least one processor and at least one memory device or storage device. The PED includes at least one PED processor configured to transmit and receive data or signals representing events, messages, commands, or any other suitable information between the PED and the central server, central controller, or remote host. The at least one processor of that PED is configured to execute the events, messages, or commands represented by such data or signals in conjunction with the operation of the PED. Moreover, the at least one processor of the central server, central controller, or remote host is configured to transmit and receive data or signals representing events, messages, commands, or any other suitable information between the central server, central controller, or remote host and the PED. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the PED. It should be further appreciated that one, more, or each of the functions of the at least one processor of the PED may be performed by the at least one processor of the central server, central controller, or remote host.

In certain embodiments in which the gaming system includes: (a) a PED configured to communicate with a central server, central controller, or remote host through a data network; and/or (b) a plurality of PEDs configured to communicate with one another through a data network, the data network is a local area network (LAN) in which the personal devices are located substantially proximate to one another and/or the central server, central controller, or remote host. In one example, the PEDs and the central server, central controller, or remote host are located in a gaming establishment or a portion of a gaming establishment.

In other embodiments in which the gaming system includes: (a) a PED configured to communicate with a central server, central controller, or remote host through a data network; and/or (b) a plurality of s configured to communicate with one another through a data network, the data network is a wide area network (WAN) in which one or more of the PEDs are not necessarily located substantially proximate to another one of the PEDs and/or the central server, central controller, or remote host. It should be appreciated that systems in which the data network is a WAN are substantially identical to systems in which the data network is a LAN, though the quantity of PEDs in such systems may vary relative to one another.

In further embodiments in which the system includes: (a) a PED configured to communicate with a central server, central controller, or remote host through a data network; and/or (b) a plurality of PEDs configured to communicate with one another through a data network, the data network is an internet or an intranet.

It should be appreciated that the central server, central controller, or remote host and the PED are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more PEDs, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more PEDs in combination with one or more central servers, central controllers, or remote hosts; (c) one or more PEDs in combination with one or more EGMs; (d) one or more PEDs, one or more EGMs, and one or more central servers, central controllers, or remote hosts in combination with one another; (e) a single EGM; (f) a plurality of EGMs in combination with one another; (g) a single PED; (h) a plurality of PEDs in combination with one another, (i) a single central server, central controller, or remote host; and/or (j) a plurality of central servers, central controllers, or remote hosts in combination with one another.

For brevity and clarity, each EGM and each PED of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
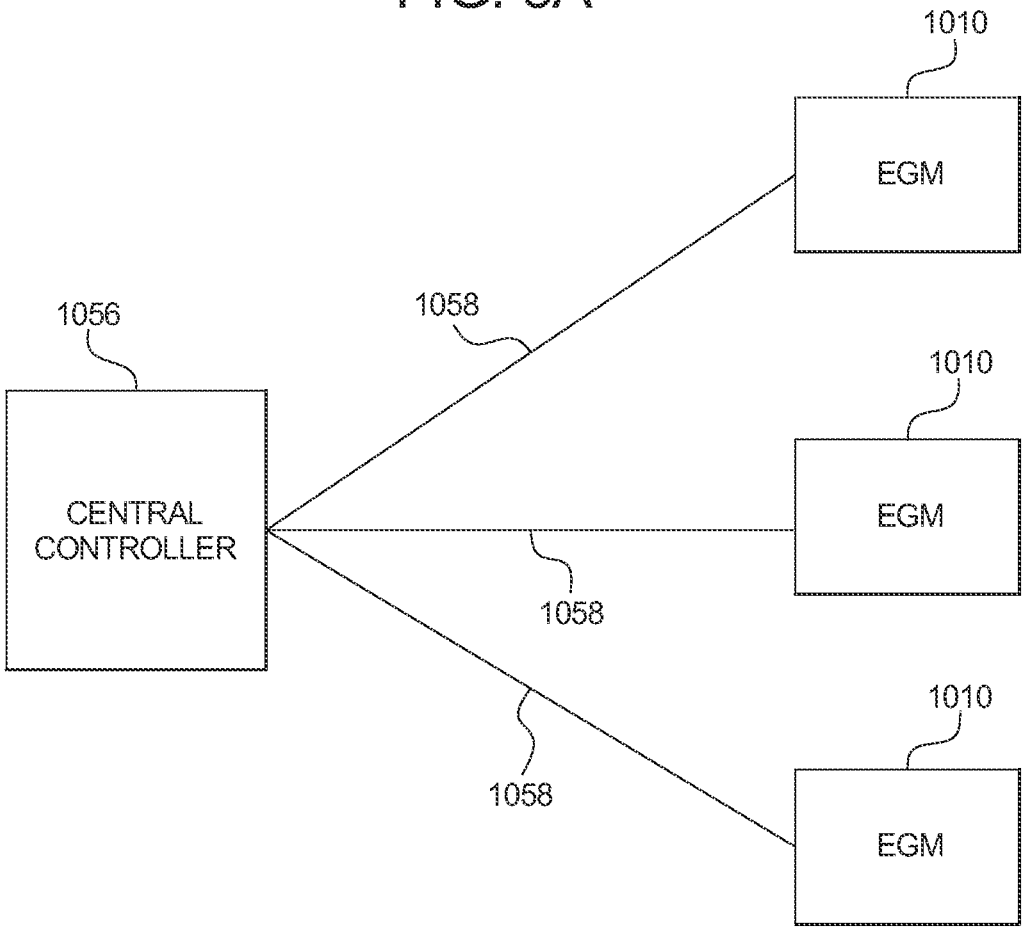
FIG. 3A is a schematic block diagram of one embodiment of a network configuration of a gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
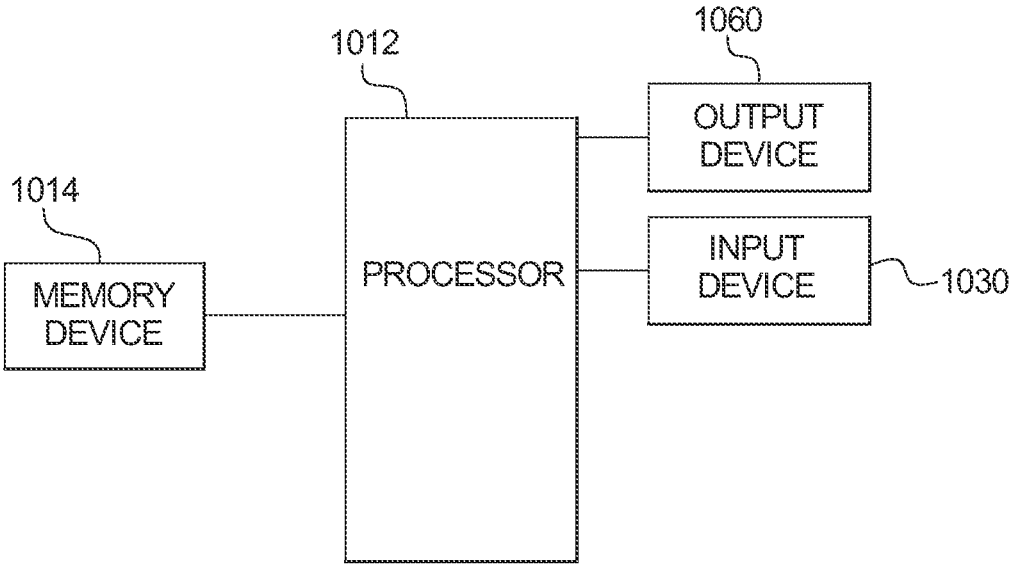
FIG. 3B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
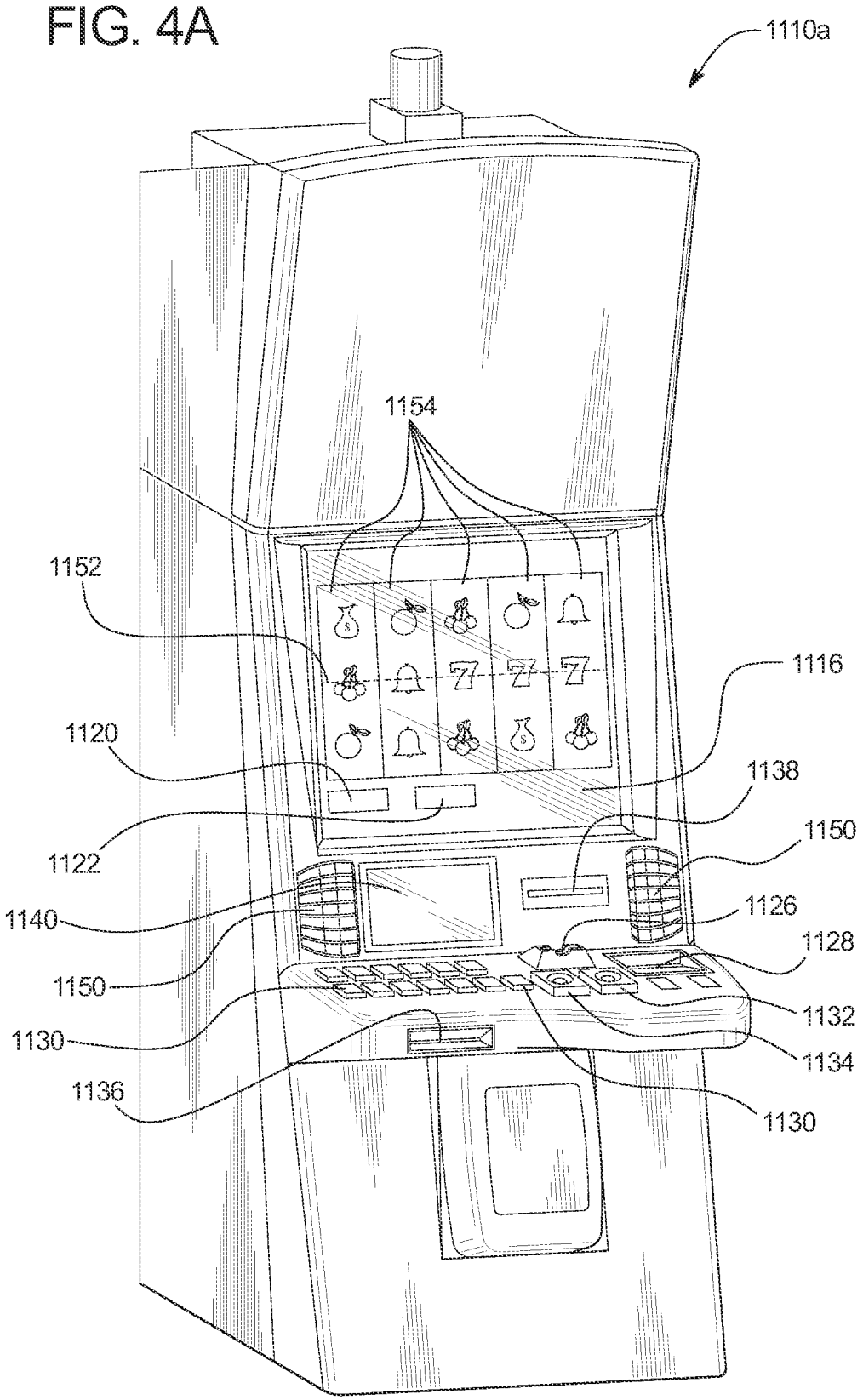
FIGS. 4A and 4B are perspective views of example alternative embodiments of the gaming system of the present disclosure.
Figure 4B:
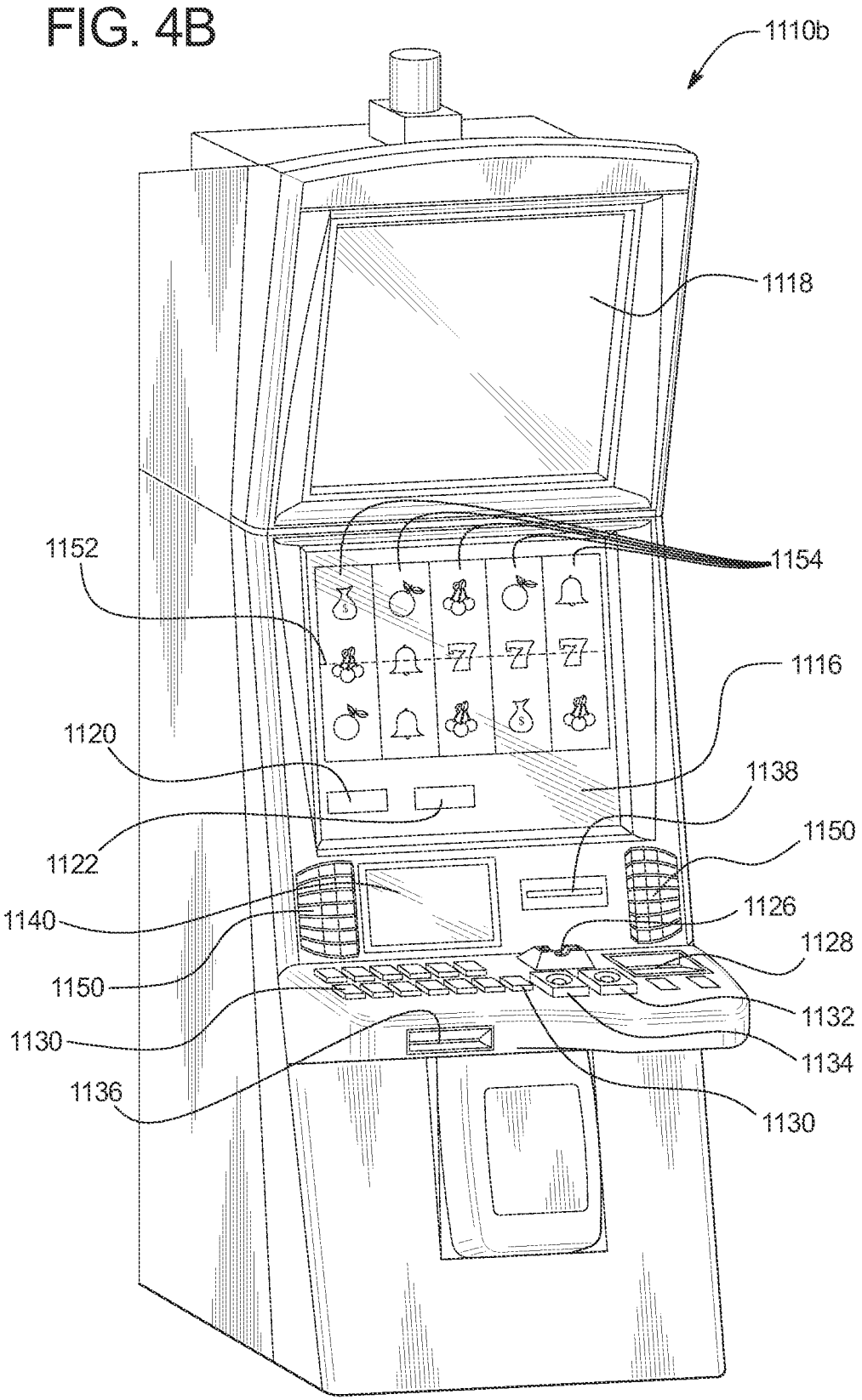

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs 1110*a* and 1110*b* illustrated in FIGS. 4A and 4B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. The example EGMs 1110*a* and 1110*b* illustrated in FIGS. 4A and 4B each include one or more input devices 1130.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs 1110*a* and 1110*b* illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 1110*a* illustrated in FIG. 4A includes a central display device 1116, a player tracking display 1140, a credit display 1120, and a bet display 1122. The example EGM 1110*b* illustrated in FIG. 4B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs 1110*a* and 1110*b* illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs 1110*a* and 1110*b* illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs 1110*a* and 1110*b* illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 1110*a* and 1110*b* shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the PEDs of the present disclosure are collectively referred to herein as "EGMs." Accordingly, it should be appreciated that certain of the example EGMs described above include certain elements that may not be included in all EGMs. For example, the payment device of a PED such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs 1110*a* and 1110*b* shown in FIGS. 4A and 4B include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method comprising:

without receiving any inputs from a player:

accessing, by at least one processor and through a data network, a player account associated with the player such that player friend data is collectable from the accessed player account;

collecting, by the at least one processor the player friend data from the accessed player account;

determining, by the at least one processor and based on the collected player friend data, at least one friend of the player;

for each determined friend:

determining, by the at least one processor, whether a stored friend database associated with the player includes that friend; and responsive to determining, by the at least one processor, that the stored friend database does not already include that friend, updating, by the at least one processor, the stored friend database to include that friend; and responsive to determining that a bonus triggering event occurred in association with a play of a first game by the player and that a friend included in the stored friend database associated with the player initiated a play of a second game on a gaming system within a designated period of the occurrence of the bonus triggering event, causing, by the at least one processor, at least one bonus game to be provided to the player and the friend, wherein the at least one bonus game includes a communal bonus game playable by both the player and the friend.

2. The method of claim 1, wherein the at least one player account includes at least one social media account associated with the player.

3. The method of claim 1, which includes receiving, from the player, login credentials associated with the player account that enable the player account to be accessed such that the player friend data is collectable from the accessed player account.

4. The method of claim 1, which includes, responsive to a designated event occurring in association with a play of a third game by another friend included in the stored friend database associated with the player, causing, by the at least one processor, a gaming system of the player to display a game update associated with said designated event and said other friend.

5. The method of claim 1, which includes, for each determined friend:

enabling, by the at least one processor, the player to input whether the player desires to include that friend in the stored friend database associated with the player;

responsive to receiving an input indicating that the player desires to include that friend in the stored friend database associated with the player, updating, by the at least one processor, the stored friend database associated with the player to include that friend responsive to said stored friend database not already including that friend; and responsive to receiving an input indicating that the player does not desire to include that friend in the stored friend database associated with the player, not updating, by the at least one processor, the stored friend database associated with the player to include that friend.

6. The method of claim 1, wherein the gaming system includes one of: (a) an electronic gaming machine, and (b) a personal electronic device of the friend.

7. The system of claim 1, wherein the gaming system includes one of: (a) an electronic gaming machine, and (b) a personal electronic device of the friend.

8. A system comprising:

at least one processor; and at least one memory device that stores a plurality of instructions that, when executed by the at least one processor, cause the at least one processor to:

without receiving any inputs from a player:

access, through a data network, a player account associated with the player such that player friend data is collectable from the accessed player account;

collect the player friend data from the accessed player account;

determine, based on the collected player friend data, at least one friend of the player;

for each determined friend:

determine whether a stored friend database associated with the player includes that friend; and responsive to determining that the stored friend database does not already include that friend, update the stored friend database to include that friend; and responsive to determining that a bonus triggering event occurred in association with a play of a first game by the player and that a friend included in the stored friend database associated with the player initiated a play of a second game on a gaming system within a designated period of the occurrence of the bonus triggering event, cause at least one bonus game to be provided to the player and the friend, wherein the at least one bonus game includes a communal bonus game playable by both the player and the friend.

9. The system of claim 8, wherein the at least one player account includes at least one social media account associated with the player.

10. The system of claim 8, wherein the plurality of instructions, when executed by the at least one processor, cause the at least one processor to receive, from the player, login credentials associated with the player account that enable the player account to be accessed such that the player friend data collectable from the accessed player account.

11. The system of claim 8, wherein the plurality of instructions, when executed by the at least one processor, cause the at least one processor to, responsive to a designated event occurring in association with a play of a third game by another friend included in the stored friend database associated with the player, cause a gaming system of the player to display a game update associated with said designated event and said other friend.

12. The system of claim 8, wherein the plurality of instructions, when executed by the at least one processor, cause the at least one processor to, for each determined friend:

enable the player to input whether the player desires to include that friend in the stored friend database associated with the player;

responsive to receiving an input indicating that the player desires to include that friend in the stored friend database associated with the player , update the stored friend database associated with the player to include that friend responsive to said stored friend database not already including that friend; and responsive to receiving an input indicating that the player does not desire to include that friend in the stored friend database associated with the player, not update the stored friend database associated with the player to include that friend.

13. A system comprising:

at least one processor; and at least one memory device that stores a plurality of instructions that, when executed by the at least one processor, cause the at least one processor to:

without receiving any inputs from a player:

access, through a data network, a player account associated with the player such that player friend data is collectable from the accessed player account;

collect the player friend data from the accessed player account;

determine, based on the collected player friend data, at least one friend of the player; and for each determined friend:

determine whether a stored friend database associated with the player includes that friend; and responsive to determining that the stored friend database does not already include that friend, update the stored friend database to include that friend;

responsive to determining that a bonus triggering event occurred in association with a play of a first game by the player and that a friend included in the stored friend database associated with the player initiated a play of a second game on a gaming system within a designated period of the occurrence of the bonus triggering event, cause a benefit to be provided to the player and the friend, wherein the benefit includes a play of a communal game shared by the player and the friend.

* * * * *